United States Patent [19]

Pongracz

[11] 4,182,443

[45] Jan. 8, 1980

[54] HANDLING PROCESS FOR STAGING MANUFACTURED ARTICLES

[75] Inventor: Endre Pongracz, Ecublens, Switzerland

[73] Assignee: SAPAL, Societe Anonyme des Plieuses Automatiques, Ecublens, Switzerland

[21] Appl. No.: 886,592

[22] Filed: Mar. 14, 1978

[30] Foreign Application Priority Data

Mar. 16, 1977 [CH] Switzerland ..... 3274/77

[51] Int. Cl.[2] ..... B65G 47/26

[52] U.S. Cl. ..... 198/460; 198/461; 198/572; 364/200; 364/900

[58] Field of Search ... 364/200 MS File, 900 MS File; 198/460, 461, 459, 572, 575, 577, 855, 466, 467, 470

[56] References Cited

U.S. PATENT DOCUMENTS

| | | | |
|---|---|---|---|
| 3,150,352 | 9/1964 | Einsel et al. | 364/900 X |
| 3,485,339 | 12/1969 | Miller et al. | 198/460 |
| 3,490,687 | 1/1970 | Bowman | 198/460 X |

*Primary Examiner*—Robert B. Reeves
*Assistant Examiner*—Douglas D. Watts
*Attorney, Agent, or Firm*—Cushman, Darby & Cushman

[57] ABSTRACT

The present invention concerns a handling process for staging manufactured articles leaving a production unit and travelling towards a receiving machine, e.g. a packaging unit working at a preset speed, and a facility for putting this process into effect. Each object or group of objects leaving the production unit is so placed to match the requirements of the receiving machine and each following the other on an endless conveyor belt staged and phased at random in relation to the correct staging and phasing for the receiving machine's operating cycle, the dephasing of each article is measured in relation to a reference signal which defines the zero angle of the working cycle of the receiving machine, this reference signal immediately preceding detection of the said article, the instantaneous speed of the receiving machine is measured, each article is speeded up or slowed down in at least one regulating station in relation to the measured dephasing and the speed of the receiving machine, and the said article on leaving the regulating station is transferred to an endless conveyor belt travelling in synchronisation with the receiving machine. The purpose of the handling process and of the facility is to arrange the articles as they arrive in column and correctly aligned but with random staging and phase so that they can be conveyed to the packaging machine with the correct staging and phase, so that the proper operation of the machine is ensured.

11 Claims, 7 Drawing Figures

HANDLING PROCESS FOR STAGING MANUFACTURED ARTICLES

BACKGROUND OF THE INVENTION

The present invention concerns a handling process for staging manufactured articles leaving a production unit and travelling towards a receiving machine, e.g., a packaging unit working at a preset speed, and a facility for putting this process into effect.

Normally, when a production line delivers manufactured goods at a speed of its own and these goods have to be packaged by a machine also working at a rhythm of its own, a problem arises of synchronising the two operating cycles.

This problem is frequently solved by simply allowing the goods to accumulate in column in front of a barrier which opens and closes in synchronisation with the rhythm at which the packing machine works. The leading product may be separated from the column by various separating devices, synchronised with the packaging machine, or simply by synchronising the conveyor belt passing beneath the barrier with the speed of the packaging unit. A particular illustration of this type of separating device appears in the German patent application No. 2,243,906, published before examination.

However, this approach incorporates two major inconveniences, as follows:

The goods do not accumulate without producing a certain pressure along the line in which they are conveyed, due to the coefficient of friction of the conveyor belt against the base of the products accumulated in the column. This pressure may deform the goods at the head of the column and make them unsuitable for packaging.

Further, to prevent the goods leaving at the sides or piling on top of each other, the column must be surrounded with guides which hold the goods at the top and at the sides.

The friction between the base of the goods and the conveyor belt produces heat and wear on the two contact surfaces. Further, where foodstuffs are concerned, e.g., chocolate, there is some risk of the conveyor belt becoming soiled.

Another approach is to use a chain which moves in synchronisation with the packaging unit and includes a certain number of barriers staged exactly according to the operating cycles of the packaging machine. A particular illustration of this type of machine appears in Swiss Pat. No. 439,063, German patent application No. 1,288,509 published after examination, and the present holder's German Pat. No. 2,150,954. The goods are packaged on entering the facility in such a way that their rate is slightly higher than that of the barriers forming part of the chain. A detector system operates the barriers in such a way that they fall into the spaces separating the successive products along the conveyor belt. The speed of the belt being greater than that of the chain bearing the barriers, the goods move towards the barriers at a speed equal to the difference of the speed of the chain bearing the barriers, and that of the conveyor belt, up to the point of their impact against the said barriers. From that point, their rate is governed by the rate of the barriers forming part of the said chain.

This system, too, contains a number of inconveniences, particularly because the risk of soiling owing to friction between the base of the goods and the conveyor belt still exists. Furthermore, if the machine is to operate at a high speed, it must be equipped with a large number of barriers, which considerably increases the space taken up by the system.

OBJECTS AND SUMMARY OF THE INVENTION

The present invention is intended to avoid these various inconveniences by a simple and efficacious handling process working at a high speed and allowing goods issuing from a production line or from physical processing to be conveyed towards a packaging unit in the synchronisation with the operating cycle of the latter.

With this in view, in the process according to the invention, each object or group of objects leaving the production unit is so placed to match the requirements of the receiving machine and each following the other on an endless conveyor belt staged and phased at random in relation to the correct staging and phasing for the receiving machine's operating cycle, the dephasing of each article is measured in relation to a reference signal which defines the zero angle of the working cycle of the receiving machine, this reference signal immediately preceding detection of the said article, the instantaneous speed of the receiving machine is measured, each article is speeded up or slowed down in at least one regulating station in relation to the measured dephasing and the speed of the receiving machine, and the said article on leaving the regulating station is transferred to an endless conveyor belt travelling in synchronisation with the receiving machine.

The facility for putting this process into effect comprises at least two sections of endless conveyor belt moved in synchronisation with the packaging unit and separated by at least one regulating station comprising at least two conveyor belts moved simultaneously at the same speed by a drive motor and separated by a distance at least approximately equal to one length of the articles conveyed, at least one article detector to determine the dephasing of each article in relation to the reference signal, a pulse generator providing the said reference signal defining the zero angle of the working cycle of the receiving machine, a generator providing a signal in relation to the speed of the receiving machine, a computer to determine the dephasing of each article in relation to correct staging and phase, and a control unit for the drive motor to effect the speeding up and slowing down of the conveyor belts of the regulating station in relation to the dephasing determined by the computer and to the measured instantaneous speed of the receiving machine.

BRIEF DESCRIPTION OF THE DRAWINGS

The present invention may be more easily explained by reference to the description of an embodiment and the appended drawing, in which.

DETAILED DESCRIPTION

Figure 1A:
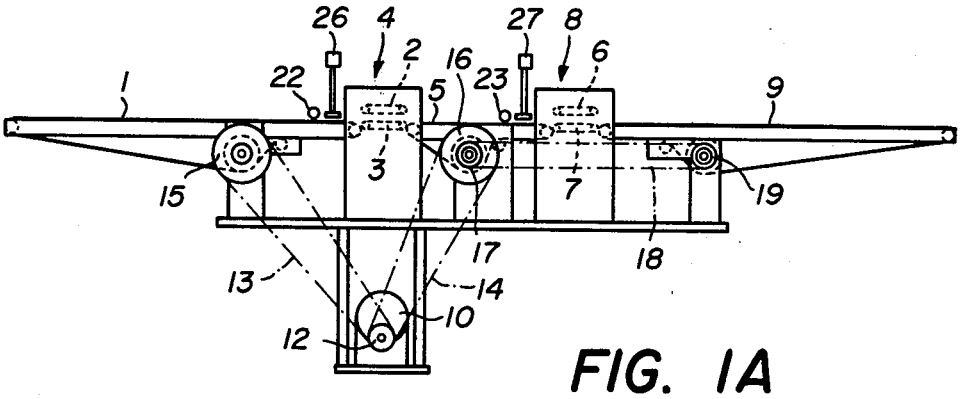
FIG. 1A and FIG. 1B respectively represent the front view and an elevation of a handling facility with two regulating stations for staging articles manufactured in accordance with the invention.
Figure 1B:
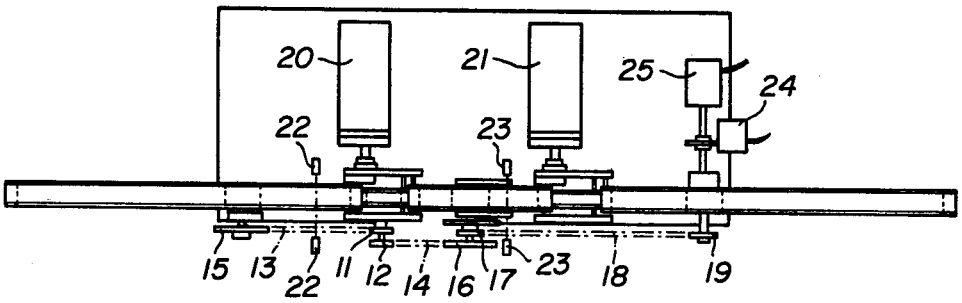

In a preferred embodiment, illustrated by FIGS. 1A and 1B, the facility includes a first section 1, of a conveyor belt on which the manufactured articles leaving a production unit or physical processing (not shown) are placed. The second section of the conveyor in the direction in which the articles are moved is formed by two conveyor belts 2 and 3 within a first regulating station 4. The conveyor belts 2 and 3 are horizontal and parallel to each other and move at the same speed and are separated from each other by a distance slightly less than the average thickness of the articles conveyed. This gap is controlled in such a way that the articles are lightly squeezed between the conveyor belts 2 and 3 without however being deformed through crushing. The two belts 2 and 3 could be replaced by three identical belts, one of which would be fixed horizontally and the others vertically so as to form a corridor between the walls of which the articles to be conveyed would be lightly squeezed. A third section, 5, is located at the end of the first regulating station to guide the said manufactured articles towards conveyor belts 6 and 7 of the second regulating station 8. The first section 9 of the conveyor belt carries the manufactured articles leaving the second regulating station towards a receiving machine, e.g., a packaging unit (not shown).

Conveyor belts 1, 5 and 9 are moved in synchronisation with the packaging unit by a drive motor 10, to the shaft of which pinions 11 and 12 are fitted, which are linked by chains 13 and 14 to the drive pinions 15 and 16 respectively of the conveyor belt sections 1 and 5. The drive shaft of section 5 is also fitted with a pinion 17 which is linked by a chain 18 to a drive pinion 19 on the conveyor belt section 9. Conveyor belts 2 and 3 of the first regulating station are driven by a motor 20. Conveyor belt 6 and 7 of the second regulating station are driven analogously by a motor 21.

Apart from the mechanical features described above, the facility includes article detectors 22 and 23 associated with regulating stations 4 and 8 respectively and arranged along conveyor belt sections 1 and 5 in order to detect the passage of the front of each successive product. These detectors preferentially consist of a light source and a photo-electric cell. A pulse generator 24 produces a pulse for each operating cycle of the packaging unit, indicating the zero angle of the machine's operating cycle. A pulse generator, e.g., a rotary incremental generator 25, produces reference pulses whose frequency is proportional to the speed of the receiving machine. Two mechanical or electro-mechanical ejector facilities 26 and 27 arranged at the entrance to each regulating station respectively are used to move goods that are likely to enter the station before the preceding article has left it.

Figure 3:
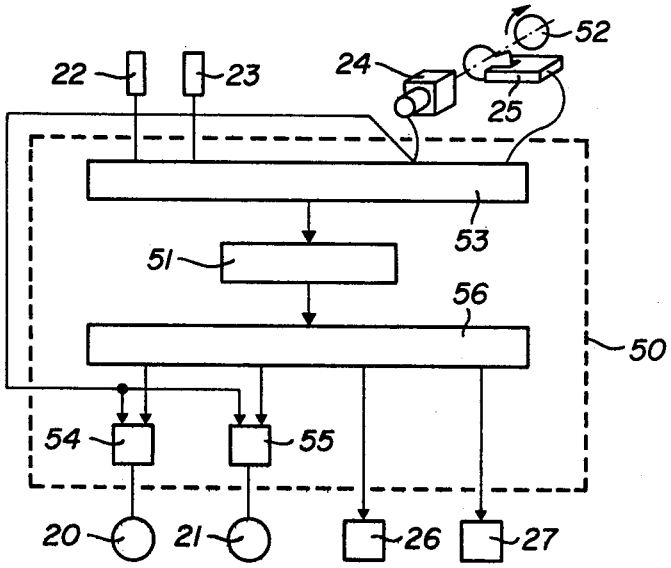
FIG. 3 represents a block diagram of the computer and its peripherals.
Figure 2A:
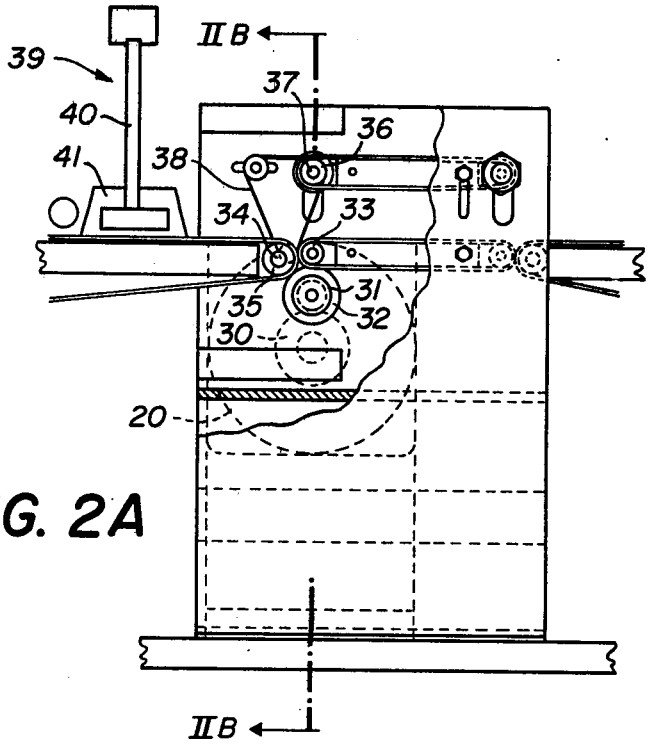
FIG. 2A represents a front view, partly cut away, of a regulating station in detail.
Figure 2B:
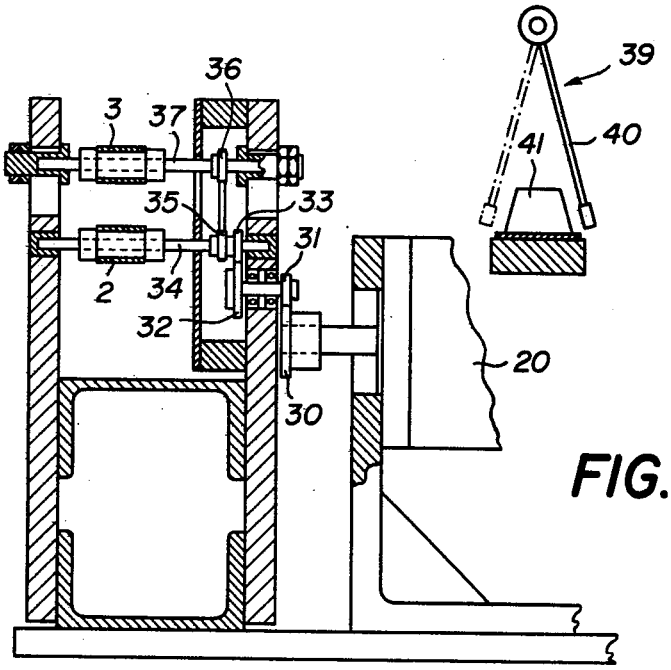
FIG. 2B represents a section along the line AA in FIG. 2A.

As shown in FIGS. 2A, 2B and 3, the motor 20 is linked by the chain on the pinions 30, 31, 32 and 33 to the drive shaft 34 of belt 2 which itself is linked by pinion 35 to pinion 36 on the drive shaft 37 of the conveyor belt 3 by belting 38. The length of section 2 is equal to the distance covered by a manufactured product on section 1 during one operating cycle of the receiving machine. Consequently, the phase correction for an article is completed within one operating cycle of the packaging unit. All these features together are mounted on conventional sectional supports forming the frame work of the facility.

A discharging device 39, located at the entrance to the regulating station consists of a moving arm 40 in a transverse plane to the conveyor belts, arranged in such a way that it can remove an article conveyed 41 when it is too far ahead and is likely to enter the regulating station before the preceding article has left it.

As FIG. 3 shows, a control computer, represented by the oblong 50 consists of a micro-computer 51 which receives signals transmitted by the detectors 22 and 23 and the generators 24 and 25 linked to the receiving machine, represented in diagram form by the circle 52, through the agency of an interface system 53 of a known type, whose role is to bundle the signals from the peripherals. On the basis of the data obtained, the micro-computer 51 determines the dephasing of each article, selects from its memory the appropriate correction program, which it transfers to the processors 54 and 55 and motors 20 and 21 through the agency of an interface system 56. The computer 50 similarly monitors the operating conditions and actuates the discharge devices 26 and 27 if articles fall outside the permissible tolerances (length and rate of flow of the articles).

The purpose of the facility described is to arrange the articles as they arrive in column and correctly aligned but with random staging and phase so that they can be conveyed to the packaging machine with the correct staging and phase, so that the proper operation of the machine is ensured.

The dephasing of an article is measured in relation to the reference signal of the zero angle of the cycle of the machine preceding the detection of the article. Consequently, the result of the measurement is always a delay, the value of which can be expressed by the inequality:

$$O<ER<T$$

where T is the length of time corresponding to a complete angle of one cycle of the machine and ER the dephasing in relation to the zero angle.

For the sake of simplicity, the zero angle of the machine is so defined that it corresponds to the passing of the tail of an article in correct phase in front of article detector 22 or 23.

In practice, the computer steps a counter incorporated in the micro-computer 51 after having received the detection signal from the head of the article and generates the "detection of the product tail" signal as soon as the time corresponding to the passing by of the maximum acceptable length of the article has expired. The dephasing of the article in relation to its correct phase is defined as the angle measured between the reference signal of the zero angle and the "detection of the product tail" signal. The computer steps a counter (similarly incorporated) after having received the reference signal or the zero angle and records the contents of the computer as a measure of the error immediately on generation of the "detection of the product tail" signal.

Updating of the above computers and the tests are carried out periodically at a frequency obtained from a signal of the incremental generator 25, and consequently is synchronised with the packaging machine. The dephasing value determined by the computer is retained in its memory and the computer selects the action program for the motor 20 or 21 when the correcting station 4 (or 8) has taken charge of the article. It will therefore be noted that this action program is determined individually for each article in relation to its measured dephasing.

Figure 4A:
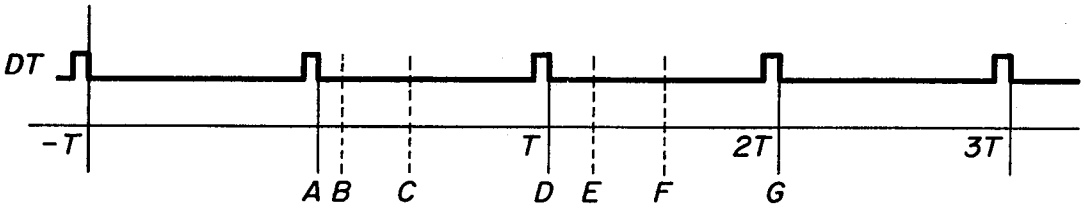
FIG. 4A represents a time chart of a typical operating cycle of the facility in FIGS. 1A and 1B and FIG. 4 illustrates the operating phases of the facility corresponding to the time chart in FIG. 4A.

The operation of the device illustrated in the preceding diagrams can be explained by reference to FIGS. 4A and 4B, which represent a time chart for the sequential operations and the geometrical position of the article at each phase of the chart with an error in the order of 0.4T (where T represents the duration of one working cycle of the packager).

The axis of the abscissae of the time chart (FIG. 4A) is broken down into intervals of time T. DT represents the reference signal of the zero angle of the machine cycle. Points A to G on the axis of the abscissae correspond to the geometrical positions of the article 41 as illustrated in FIG. 4B.

Figure 4B:
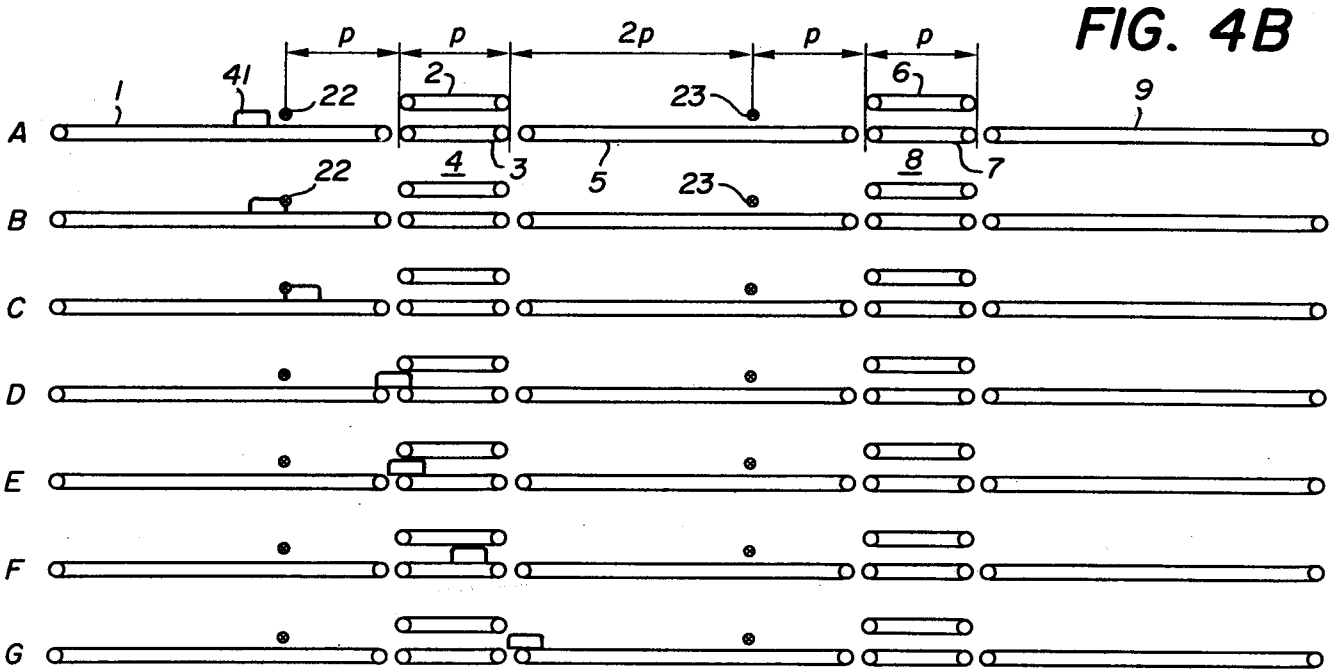

As shown in FIG. 4B, the line A illustrates the initial phase of the facility; the signal DT determines the zero angle of the receiving machine cycle. The dephasing of the article 41 carried on the conveyor belt section 1 begins to be measured at this point.

Line B illustrates phase 1, which corresponds to detection of the face of the article 41 by the detector 22. At this point, measurement of the length of the article commences.

Line C, which represents phase 2, in the course of which the computer generates the signal "detection of the product tail." Measurement of the dephasing has ended. The correcting program is now selected. The period when the article enters the regulating station 4 commences. In relation to the error measured, the computer generates a controlled delay before ordering the start of the correcting action. The purpose of this delay is to allow the article to enter between belts 2 and 3 in regulating station 4 without friction before acceleration is begun.

Phase 3, illustrated by the line D, corresponds to the zero angle of the machine's next operating cycle.

Phase 4, represented by the line E, corresponds to the end of the entry period. The article is squeezed between belts 2 and 3. The computer transfers the necessary data for executing the correcting program to the processor 54 of the motor 20.

Execution of the correcting program commences. This program provides for a progressive acceleration period and a progressive deceleration period. The kinematics of these two periods are controlled by the processor 54 of the motor 20, utilising the signal from the incremental generator 24 independently of the computer. The result of this program is the compensation of all or part of the dephasing. In practice, the limit of dephasing that can be corrected by means of a regulating station lies at 0.6T. If the dephasing is greater than 0.6T the second regulating station will make a correction analogously.

Line F, corresponding to phase 5 marks the end of the correcting program. The speed of belts 2 and 3 is again equal to the speed at which the article travels on the conveyor belt section 5.

Phase 6, illustrated by line G, corresponds to the zero angle of the machine's next operating cycle. It will be noted that the tail of the product lies at a distance $2p$ in relation to the axis of the article detector 23 and consequently, as originally defined, it lies in the correct phase (p is the distance covered by the article on the conveyor belt sections 1, 5 and 9 during an operating cycle T of the receiving machine).

If the distance between the axes of the two articles is less than p depending on the phase of the two articles and the difference between the distance between the axes and the distance p, there is a risk of the regulating stations being unable to fully complete their correcting action. The computer can monitor the ideal operating conditions of the system by using the signal of the article detector 22 (or 23), which are preferably photoelectric cells, and activate the discharge station 26, (27) through the agency of a special device, e.g., an electromagnet or a mechanical piston (not shown), by ejecting the article which fails to meet the requirements for the correct operation of the system.

If the article detector 22 (23) does not detect any article during a complete cycle T of the machine, belts 2 and 3 respectively (6 and 7) turn in synchronisation with belts 1, 5 and 9. A range of acceptable dephasing tolerances can be drawn up. If the dephasing of the article as measured lies within this range it is considered as being in the correct phase and belts 2 and 3 (6 and 7) turn in synchronisation with belts 1, 5 and 9 as they pass.

The facility described allows working at a high throughput without the article being conveyed and being staged being in any way deformed. It is simple in design and practically every mechanical feature of complex manufacture and assembly which is indispensable on known facilities has been eliminated. The result is a lowering in manufacturing cost and a considerable reduction in wear and tear and break-down of the facility.

I claim:

1. A handling process for staging manufactured articles leaving a production unit and traveling towards a receiving machine working at a preset speed; each article or group of articles leaving the production unit being oriented so as to match the requirements of the receiving machine, each article following another on an endless conveyor belt, and being staged and phased at random in relation to the correct staging and phasing for the receiving machines operating cycle; the process comprising the steps of measuring the amount by which each article is out of phase with relation to a reference signal which defines the zero angle of the working cycle of the receiving machines, this reference signal immediately preceding detection of the said article in said measuring step; measuring the instantaneous speed of the receiving machine; speeding up or slowing down each article and at least one regulating station independence on the measured amount of dephasing and the speed of the receiving machine, wherein the speeding up or slowing down of each article comprises four stages: a first stage during which the dephasing of the article is measured in relation to the zero angle of the receiving machine; a second stage during which the article enters the regulating station, traveling at the same speed as on the section of conveyor belt preceding the regulating station; a third stage during which the dephasing of the article is corrected by a speeding up and slowing down cycle, depending on its dephasing as measured; and a fourth stage during which the article leaves the regulating station and moves at the same speed as on the conveyor belt section following on the regulating station; and transferring the article on leaving the regulating station to an endless conveyor belt traveling in synchronization with the receiving machine.

2. A handling process for staging manufactured articles leaving a production unit and traveling towards a receiving machine working at a preset speed; each article or group of articles leaving the production unit being oriented so as to match the requirements of the receiving machine, each article following another on an endless conveyor belt, and being staged and phased at random in relation to the correct staging and phasing for the receiving machines operating cycle; the process comprising the steps of measuring the amount by which each article is out of phase with relation to a reference signal which defines the zero angle of the working cycle of the receiving machines, this reference signal immediately preceding detection of the said article in said measuring step; measuring the instantaneous speed of the receiving machine; speeding up or slowing down each article and at least one regulating station independence on the measured amount of dephasing and the speed of the receiving machine, wherein a tolerance range for acceptable dephasing is defined and not corrected, the conditions for the proper operation of the speed up or slowing down of each article in the regulating station are monitored, an article that fails to meet the requirements between the article detector and the regulating station being ejected, in a first regulating station correcting that part of the dephasing error corresponding to a delay of less than 0.6T, T being the duration of one cycle of the receiving machine; and in a second regulating station correcting that part of the error not corrected in the first regulating station, in the case of articles having an initial delay exceeding 0.6T; and transferring the article on leaving the second regulating station to an endless conveyor belt travelling in synchronization with the receiving machine.

3. An apparatus for spacing manufactured articles leaving a production unit and traveling towards a receiving machine working at a preset speed; each article or group of articles leaving the production unit being oriented so as to match the requirements of the receiving machine, each article following another on an endless conveyor belt, and being staged and phased at random in relation to the correct staging and phasing for the receiving machines operating cycle; which comprises at least two sections of endless conveyor belt movable in synchronisation with the receiving machine and separated by at least one regulating station; each regulating station comprising at least two conveyor belts movable simultaneously at the same speed by a drive motor and separated by a distance equal or greater than one length of the article conveyed; at least one article detector for determining the dephasing of each article in relation to the reference signal; a pulse generator for providing the reference signal defining the zero angle of the working cycle of the receiving machine; a generator for providing a signal in relation to the instantaneous speed of the receiving machine; a computer for determining the dephasing of each article in relation to correct staging and phase; and a control unit for the drive motor for effecting the speeding up and slowing down of the conveyor belts of the regulating station in relation to the dephasing determined by the computer and to the measured instantaneous speed of the receiving machine.

4. An apparatus as claimed in claim 3 wherein the two parallel conveyor belts of the regulating station are arranged so as to exert a squeezing effect on the article at least during the third stage.

5. An apparatus as claimed in claim 3 or 4, which comprises three sections of endless conveyor belt and two regulating stations each located between two of the said sections of conveyor belt.

6. An apparatus as claimed in claim 3 or 4, which comprises at least two sections of endless conveyor belt, drived in synchronisation with the receiving machine and separated by at least one regulating station, the regulating station having a horizontal conveyor belt and two vertical conveyor belts moved simultaneously at the same speed; the vertical belts being parallel and separated by a gap at least approximately equal to the width of the article conveyed.

7. An apparatus as claimed in claims 3, 4, 5 or 6, which further comprises a monitoring detector located before each regulating station at a distance therefrom equal to the distance covered by the article on the conveyor belt during one operating cycle of the receiving machine, for detecting products that could not be corrected in the regulating station.

8. An apparatus as claimed in claim 7, wherein the detectors are photo-electric cells.

9. An apparatus as claimed in claim 7, which further comprises an ejecting device placed between each regulating station and the corresponding monitoring detector for ejecting from the conveyor articles whose phase cannot be corrected.

10. An apparatus as claimed in claim 9, wherein the ejecting device is a mechanical arm governed by an electro-magnet.

11. A process as claimed in claim 1, wherein a tolerance range for acceptable dephasing is defined and not corrected, the conditions for the proper operation of the speeding up or slowing down of each article in the regulating station are monitored, an article that fails to meet the requirements between the article detector and the regulating station being ejected, and a first regulating station correcting that part of the dephasing error corresponding to a delay of less than 0.6T, T being the duration of one cycle of the receiving machine; and in a second regulating station correcting that part of the error not corrected in the first regulating station, in the case of articles having an initial delay exceeding 0.6T.

* * * * *